United States Patent [19]

Russell

[11] 4,190,151

[45] Feb. 26, 1980

[54] DISPLAY HANGER

[75] Inventor: Frederick S. Russell, Wilbraham, Mass.

[73] Assignee: Westvaco Corporation, New York, N.Y.

[21] Appl. No.: 962,181

[22] Filed: Nov. 20, 1978

[51] Int. Cl.[2] ..... B65D 85/18

[52] U.S. Cl. ..... 206/281; 206/288; 206/459; 40/360; 40/21 R

[58] Field of Search ..... 206/281, 288, 284, 459, 206/299, 278, 283, 292, 296; 40/359, 360, 21 R; 223/87, 85

[56] References Cited

U.S. PATENT DOCUMENTS

| | | | |
|---|---|---|---|
| 1,012,586 | 12/1911 | Ball, Jr. | 40/360 |
| 1,048,577 | 12/1912 | Pardoe, Jr. | 40/359 |
| 1,687,859 | 10/1928 | Fontaine | 229/48 SB |
| 1,780,558 | 11/1930 | Kavanau | 206/281 |
| 2,374,695 | 5/1945 | Murray | 40/359 |
| 2,855,649 | 10/1958 | Kanter | 206/284 |
| 2,877,736 | 3/1959 | Simmons . | |
| 3,205,603 | 9/1965 | Brumley . | |
| 3,228,129 | 1/1966 | Gwinn et al. | 40/21 R |
| 3,462,006 | 8/1969 | Scott . | |
| 4,014,436 | 3/1977 | Tunis | 206/299 |

FOREIGN PATENT DOCUMENTS

| | | | |
|---|---|---|---|
| 595068 | 3/1960 | Canada | 206/284 |
| 560942 | 10/1932 | Fed. Rep. of Germany | 40/360 |

*Primary Examiner*—Joseph Man-Fu Moy

[57] ABSTRACT

A display hanger for articles is formed from a single blank of relatively stiff material such as paperboard and is printed on one side with advertising and identification graphics including incremental price information. The single blank is cut and scored to form a main body panel, a pair of garment supporting side flaps and a pair of interlocking side flaps which retain one or more of the garments on the display hanger. The upper portion of the main body panel is reinforced and includes a cutout for supporting the display hanger on a companion support member such as a pin type display panel. Meanwhile, the improvement comprises an extension flap foldably attached to the lower end of said main body panel wherein the incremental price information is printed on individual tab elements that are integral with but selectively removable from said extension flap. The extension flap is normally folded behind and secured to the rear of the main body panel with a single price tab folded into view. Then, when price changes occur, the old price tabs may be removed and new price information tabs may be selectively folded into view.

1 Claim, 4 Drawing Figures

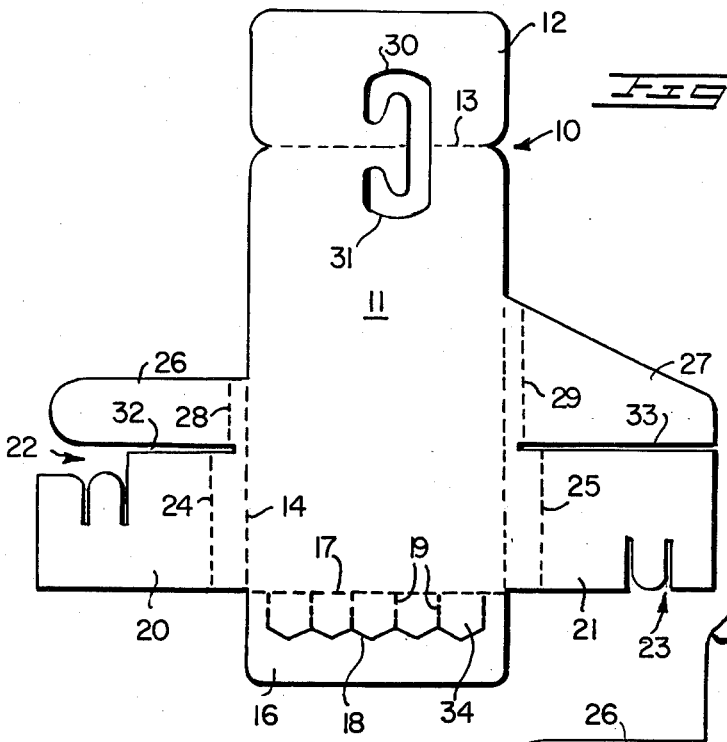
Fig 1.
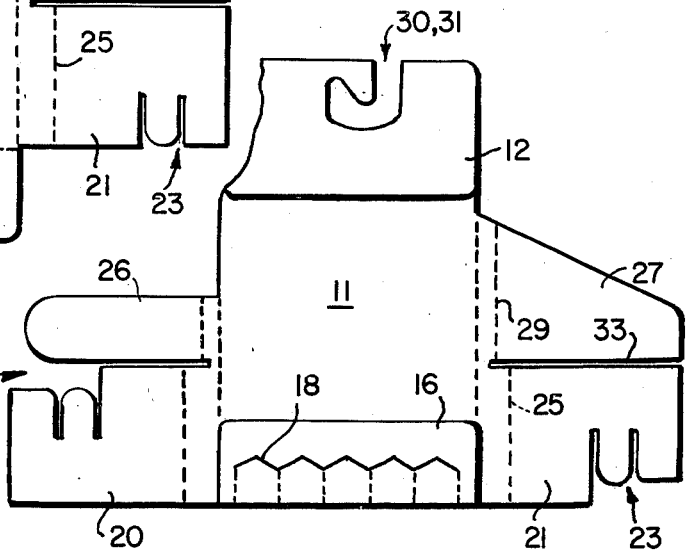
Fig 2.
Fig 3.
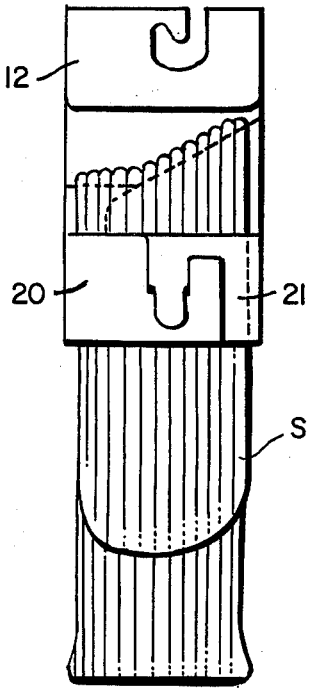
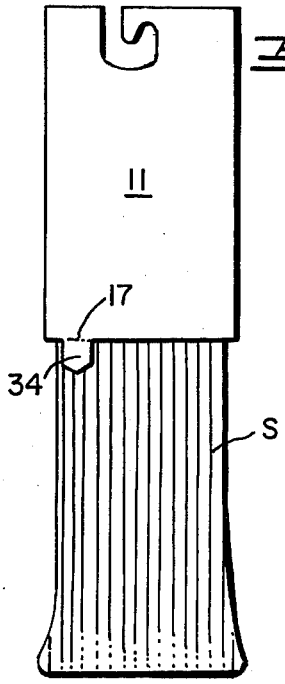
Fig 4.

DISPLAY HANGER

BACKGROUND OF INVENTION

The use of hanging packages made from stiff material such as paperboard, plastic and combinations thereof are well known in the art, particularly for the display of clothing, hardware and other goods on point of purchase displays. Generally, these packages take the form of blister packs mounted on paperboard, envelopes with windows and/or hanger type folders which include interlocking flaps for supporting and retaining the goods on the hanger. In addition, all of the above mentioned packages usually contain an opening or cutout in one end thereof for suspending the package from a pin element on a point of purchase display. However, in each case, no convenient means has been provided as an integral part of the package for indicating price changes of the packaged goods. Thus, in some instances, retailers have found themselves with identical goods on display with different prices indicated, particularly where a new shipment at a higher price has been received before all of the old goods have been sold.

Accordingly, by the present invention a means is disclosed that is integral with the hanger element for selectively displaying incremental price changes as necessary during the time that the hangers are displayed. For convenience, and only by way of example, the invention is illustrated in connection with a hanger for packaging hosiery or the like. The incremental price information is printed on the hanger element at the time the advertising and other product graphics are printed. However, except for the current price, the price information remains concealed from view when the goods are packaged. Subsequently, as price changes occur, the old price may be readily removed from the package and new price information folded into view.

SUMMARY OF INVENTION

It is the general purpose of the present invention to provide a one piece display hanger particularly for the display of clothing such as hosiery, gloves, scarfs and other soft goods on point of purchase displays. The display hanger serves the several purposes of providing a label for identifying the goods, keeps a matched pair of the goods from becoming separated, and includes an integral means for effecting changes in the price of the goods while they remain on the display. In the past, price changes have been made on goods on display with the use of individual pressure sensitive stickers or the like, applied by store personnel at a great cost in time and effort. The price changes when so made have been a source of problems, particularly where the new price has not been applied so as to cover the old price, and, even if properly applied, the price changes are obvious to the consumer. Accordingly, by the present invention, an integral means has been incorporated into a hanger type display folder that may be used to effect incremental price changes as necessary without such price changes being obvious to the consumer. For this purpose, an extension flap is included on the main body panel of a hanger type display folder that is divided into a plurality of integral tab elements each separated from one another and from the extension flap by perforated lines. The incremental price information is printed on the individual tab elements, and with the current price tab separated from the remaining price tabs and folded into view, the extension flap containing the remaining price tabs is folded behind and secured to the back of the main body panel of the display hanger out of view. Subsequently, when it is desired to effect price changes, the price tab showing the old (current) price is removed and the price tab showing the new price is separated from the remaining price tabs and folded into view. In this manner, price changes can be effected for the goods displayed easily and readily without leaving any evidence that a price change has been made. Moreover, because the incremental price information is not readily accessible from the front of the display hanger, unauthorized tampering with the pricing of the merchandise is substantially reduced.

BRIEF DESCRIPTION OF THE DRAWING FIGURES

FIG. 1 is the blank of the invention.

FIG. 2 is the blank of the invention showing the price tag folded.

FIG. 3 is the back view of the folded blank with an article.

FIG. 4 is the front view of the folded blank with a displaying price tag.

DESCRIPTION OF DRAWING

Referring now to FIG. 1, there is shown a typical blank from which the display hanger of the present invention can be formed. The basic blank structure 10 is of generally T-shaped construction and comprises a main body panel 11, an upper reinforcing panel 12 foldably attached thereto along score line 13, a lower price tab panel 16 foldably attached thereto along score line/-perforated line 17 and a plurality of side flaps 20,21 and 26,27 foldably attached thereto along score lines 14,15. The upper reinforcing panel 12 and the top portion of the main body panel 11 each include suitable cutouts 30,31 which coincide with one another when panel 12 is adhered to panel 11, and together they form the means whereby the display hanger is supported on a pin type display board. Meanwhile, the paired flaps 20,21 at each side of the main body panel 11 are each formed with cooperating panel locks 22,23 which become engaged with one another when the product is loaded on the hanger.

In this regard, the display hanger illustrated herein is intended for packaging hosiery such as regular socks or tube socks. For this purpose, the additional side panels 26,27 are used for supporting the different style hosiery on the blank before the locking panels 20,21 are secured. For instance, when regular socks with a conventional heel gore are packaged, the panel 27 is used to support the hosiery. Meanwhile, for tube type socks, panel 26 serves as the means for holding the hosiery in place prior to securing the locking panels 20,21. Note further that the side panels 20,26 and 21,27 are separated from one another by cut lines 32,33 respectively, and are joined to the main body panel 11 by offset score lines 28,29. In like manner, a pair of offset score lines 24,25 are applied in the locking flaps 20,21. The latter fold lines are provided in the blank to accomodate the thickness of the packaged hose. For instance, score lines 28,29 are spaced from the nominal score lines 14,15 by a distance substantially equal to the thickness of a pair of the packaged hosiery in side-by-side relationship. However, since the hosiery is folded around one of the panels 26,27 during packaging, the score lines 24,25 must be separated from the nominal score lines 14,15 by a distance to accomodate the folded over double thickness of the hosiery.

The remainder of the blank structure includes the price tab panel 16 which is divided into a plurality of tabs 34 by the cut line 18 and the perforated lines 19. The cut line 18 is formed in the shape of connected V's for illustration only. Obviously, other shapes could be used if desired. The tabs 34 are separated from one another by the perforated lines 19 and from the main body panel 11 and flap 16 by the perforated line 17.

As shown in FIG. 2, when the display hanger is folded and glued, the reinforcing panel 12 is adhered to the inside (opposite the printed side) of main panel 11. Similarly, the price tab panel 16 is folded and adhered to the inside of main panel 11 at the lower end. This step insures that the price tabs are normally hidden from the view of a perspective purchaser when the hanger is displayed. When the package is loaded, a pair of hosiery is placed on the open blank shown in FIG. 1. The hosiery is then folded over either the flap 27, when heel gore hosiery is packaged, or the flap 26 when tube socks are packaged, before the locking flaps 20,21 are folded over and secured.

FIG. 3 is a view of the backside of the hanger with the locking flaps 20,21 secured. In this manner, the flaps 26,27 serve as a support to prevent the hosiery from falling out of the package and the locking flaps further secure the hosiery to the main body panel 11. When the hosiery is packaged at the factory, the recommended retail price is generally known, and the price tab 34 corresponding to that price is folded downwardly into view as shown in FIG. 4. Later, when subsequent price changes occur, it is a simple matter to remove the old price tab and fold down a new price tab.

Thus it may be seen that the package disclosed herein provides a convenient and easily manipulated means for effecting incremental price changes in a product on display without such price changes being readily apparent to a prospective purchaser. As mentioned hereinbefore, the display hanger is disclosed in detail for packaging hosiery. However, it obviously could be adapted for the display of any soft goods while retaining the price change feature disclosed. Accordingly, it will be obvious to those skilled in the art that various changes may be made without departing from the scope of the invention as set forth in the appended claims.

I claim:

1. A display hanger for garments or the like formed from a single blank of relatively stiff material such as paperboard comprising, a main body panel having front and rear surfaces, said front surface being adapted to have printing matter applied thereon, a reinforcing flap foldably attached to the upper end of said main body panel and adhered to the unprinted rear surface thereof so that cut outs formed in both said reinforcing flap and main body panel coincide to form a means for suspending the hanger from a companion support member, a first pair of interlocking flaps foldably attached to the side edges of said main body panel for retaining one or more garments on said hanger, and a second pair of flaps foldably attached to the side edges of said main body panel for supporting the garments displayed, the improvement comprising an extension flap attached to the lower end of said main body panel that is normally folded out of view and adhered to the rear surface of said main body panel, said extension flap further comprising a plurality of separate tab elements that are printed with indicia to indicate incremental pricing information for the garments so displayed and that are adapted to be selectively folded into view, said tab elements being of substantially the same width and length but having an overall length that is less than the length of said extension flap so that the end of said extension flap remote from said tab elements can be adhered to the unprinted rear surface of said main body panel, said tab elements being separated from one another and from the extension flap by perforated lines so that when price changes occur, the previously exposed price tab elements may be removed and others folded into view.

* * * * *